US009327497B2

(12) United States Patent
Ito

(10) Patent No.: US 9,327,497 B2
(45) Date of Patent: May 3, 2016

(54) LIQUID DISCHARGE APPARATUS

(71) Applicant: Brother Kogyo Kabushiki Kaisha, Nagoya-shi, Aichi-Ken (JP)

(72) Inventor: Yuichi Ito, Mie-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/547,563

(22) Filed: Nov. 19, 2014

(65) Prior Publication Data

US 2015/0138265 A1 May 21, 2015

(30) Foreign Application Priority Data

Nov. 20, 2013 (JP) ..... 2013-239526

(51) Int. Cl.
*B41J 29/38* (2006.01)
*B41J 2/045* (2006.01)

(52) U.S. Cl.
CPC ..... *B41J 2/04581* (2013.01); *B41J 2/04588* (2013.01); *B41J 2/04596* (2013.01)

(58) Field of Classification Search
CPC ..... B41J 2/04596
See application file for complete search history.

(56) References Cited

U.S. PATENT DOCUMENTS

| | | | | |
|---|---|---|---|---|
| 7,416,269 | B2 * | 8/2008 | Iwao | 347/11 |
| 2007/0139487 | A1 | 6/2007 | Sekiguchi | |
| 2008/0084457 | A1 * | 4/2008 | Hibi et al. | 347/70 |

FOREIGN PATENT DOCUMENTS

| | | |
|---|---|---|
| JP | 2005-193435 | 7/2005 |
| JP | 2007-160819 | 6/2007 |

* cited by examiner

*Primary Examiner* — Shelby Fidler
(74) *Attorney, Agent, or Firm* — Frommer Lawrence & Haug LLP

(57) ABSTRACT

A liquid discharge apparatus includes: a channel unit including: a discharge port; a first channel through which liquid to be supplied to the discharge port flows; and a second channel communicated with the first channel and the discharge port; an actuator including a first and second electrodes and a piezoelectric layer, and being configured to apply pressure to the liquid in the second channel; and a signal supply unit configured to selectively supply a discharge driving signal and a non-discharge driving signal to the actuator. The discharge driving signal includes a first voltage signal which drives the actuator to discharge the liquid from the discharge port, and the non-discharge driving signal includes a plurality of second voltage signals each of which drives the actuator not to discharge the liquid from the discharge port.

8 Claims, 9 Drawing Sheets

LIQUID DISCHARGE APPARATUS

CROSS REFERENCE TO RELATED APPLICATION

The present application claims priority from Japanese Patent Application No. 2013-239526 filed on Nov. 20, 2013, the disclosure of which is incorporated herein by reference in its entirety.

BACKGROUND OF THE INVENTION

1. Field of the Invention

The present invention relates to a liquid discharge apparatus including a channel unit in which discharge ports through which liquid is discharged are formed.

2. Description of the Related Art

Japanese Patent Application Laid-open No. 2005-193435 describes that preparatory or alternative waveform is applied to an actuator to prevent the increase in viscosity of ink (to prevent the drying of ink), Further, Japanese Patent Application Laid-open No. 2005-193435 also describes that the reverberation of vibration caused by the preparatory waveform can be prevented by supplying a pulse after the pulse of the preparatory waveform to deviate therefrom by 0.54 times of the proper or characteristic period of a pressure chamber.

SUMMARY OF THE INVENTION

In the conventional technology, the interval between pulses is adjusted in view of the prevention of the reverberation of vibration caused by the preparatory waveform. Although the reverberation of vibration caused by the preparatory waveform can be prevented in the conventional technology, the vibration cannot be used effectively. Thus, there is fear that the increase in viscosity in the vicinity of meniscuses might not be effectively prevented.

An object of the present invention is to provide a liquid discharge apparatus in which meniscuses can be vibrated effectively.

According to an aspect of the present teaching, there is provided a liquid discharge apparatus configured to discharge liquid, including:

a channel unit including: a discharge port through which the liquid is discharged; a first channel through which the liquid flows to be supplied to the discharge port; and a second channel which has one end communicated with the first channel and the other end communicated with the discharge port;

an actuator including: a first electrode; a second electrode; and a piezoelectric layer sandwiched between the first and second electrodes, and being configured to apply pressure to the liquid in the second channel by deforming the piezoelectric layer relative to the second channel due to a difference in electric potential between the first and second electrodes; and a signal supply unit configured to selectively supply a discharge driving signal and a non-discharge driving signal to the actuator, the discharge driving signal including a first voltage signal which drives the actuator to discharge the liquid from the discharge port, and the non-discharge driving signal including a plurality of second voltage signals each of which drives the actuator not to discharge the liquid from the discharge port, wherein each of the first voltage signal and the second voltage signals goes through a first state, a second state, and a third state in this order and goes back to the first state, the first state being a state in which a voltage between the first and second electrodes is kept at a predetermined voltage, the second state being a state in which the voltage between the first and second electrodes monotonically decreases from the predetermined voltage, the third state being a state in which the voltage between the first and second electrodes monotonically increases to the predetermined voltage, and the non-discharge driving signal is adjusted so that any two consecutive second voltage signals among the plurality of second signals satisfy a condition that: $T0<Wb<T0+2Tf$, where Wb is a length of time elapsed after the third state of the former second voltage signal is started until the second state of the latter second voltage signal is started, T0 is a proper vibration period of the second channel, and Tf is a length of time during which the voltage of the first voltage signal in the discharge driving signal is in the third state.

By adjusting the non-discharge driving signal in the range of the present teaching, it is possible to adequately prevent the liquid in the vicinity of meniscuses from drying as shown by an operation test which will be described later.

DESCRIPTION OF THE EMBODIMENTS

Figure 1:
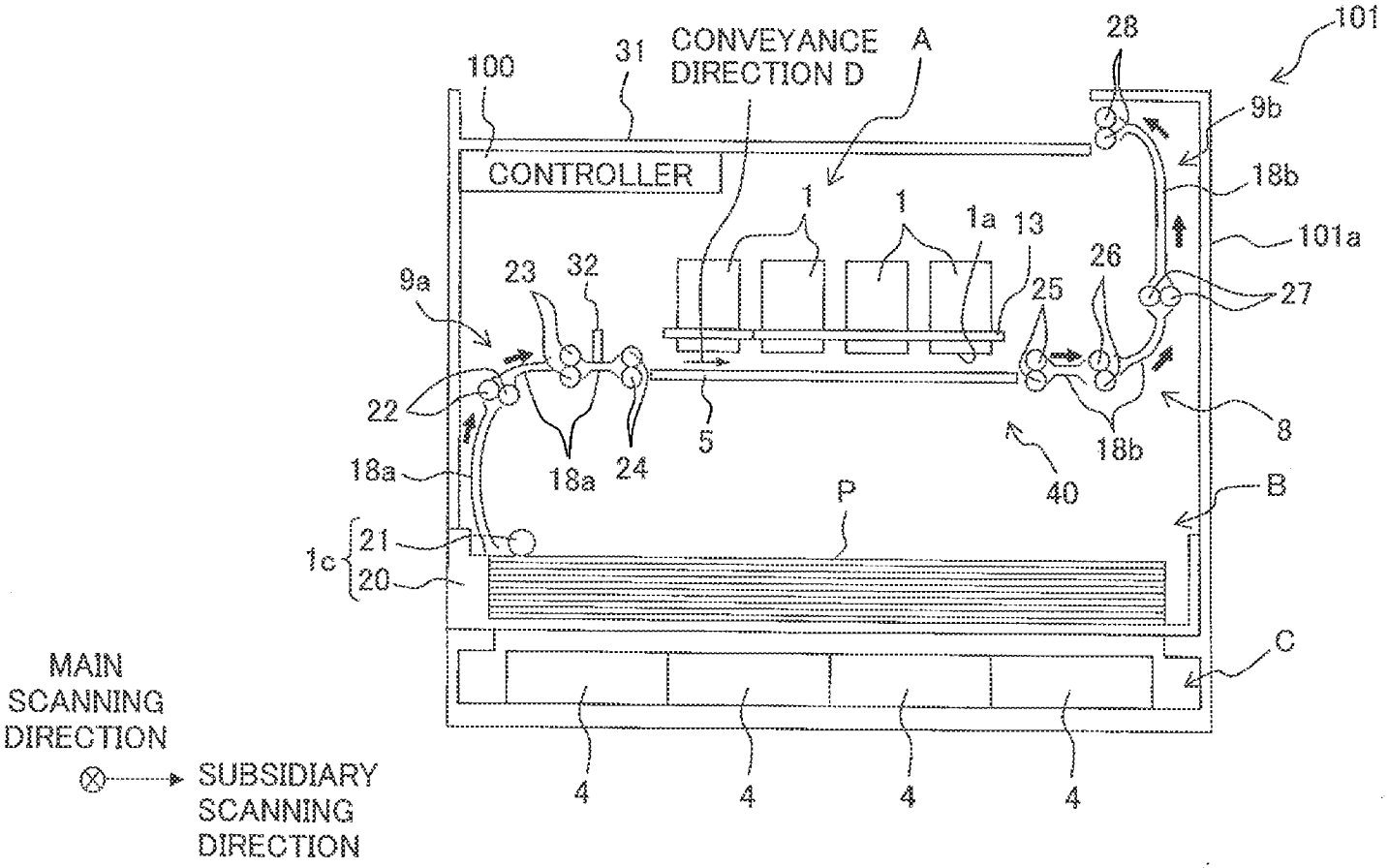
FIG. 1 is a schematic cross-sectional view depicting an internal structure of an ink-jet printer to which an ink-jet bead according to an embodiment of the present teaching is applied.

Hereinafter, an explanation will be made about a preferred embodiment of the present teaching while referring to the drawings.

At first, an explanation will he made about the overall structure of an inkjet printer 101 as an embodiment of a liquid discharge apparatus according to the present teaching while referring to FIG. 1.

The printer 101 has a casing 101*a* in a rectangular parallelepiped shape. A discharge unit 31 is provided at an upper portion of a ceiling plate of the casing 101*a*. The internal space of the casing 101 a can he classified into spaces A, B, and C in this order from the top. A conveyance path which reaches the discharge unit 31 from a feed unit 1*c* is formed in the spaces A and B, and a sheet P is conveyed along black thick arrows depicted in FIG. 1. In the space A, the image formation on the sheet P and the conveyance of the sheet P to the discharge unit 31 are performed. In the space B, the feeding of sheet P to the conveyance path is performed. From the space C, inks are supplied to heads 1 in the space A.

In the space A, four heads 1 which discharge the inks having mutually different four colors, a conveyance mechanism 8, a sheet sensor 32, a controller 100, and the like are disposed. The controller 100 controls the operation of each component or part of the printer to manage the operation of the entire printer 101.

The conveyance mechanism 8 includes a platen 5 and two guide units 9*a*, 9*b* to guide the sheet P. The two guide units 9*a*, 9*b* are disposed with the platen 5 intervening therebetween. The guide unit 9*a* disposed on the upstream side in a conveyance direction includes three guides 18*a* and three feed roller pairs 22 to 24, and the guide unit 9*a* connects the feed unit 1*c* and the platen 5. The guide unit 9*a* conveys the sheet P on which the image is to he formed to the platen 5. The guide unit 9*b* disposed on the downstream side in the conveyance direction includes three guides 18*b* and four feed roller pairs 25 to 28, and the guide unit 9*b* connects the platen 5 and the discharge unit 31. The guide unit 9*b* conveys the sheet P on which the image has been formed to the discharge unit 31.

The four heads 1 correspond to the four color inks of black, cyan, magenta, and yellow, respectively. Each of the heads 1 has a plurality of discharge ports 108 (see FIG. 4) through which one of the inks is discharged. The discharge ports 108 are formed to open in a lower surface 1*a* (hereinafter referred to as "discharge surface 1*a*") of each of the heads 1. The heads 1 are supported by the casing 101*a* via a head holder 13. The head holder 13 is allowed to move upward and downward by a lifting device provided in the space A. The controller 100 controls the head holder 13 to move upward and downward. By allowing the head holder 13 to move upward and downward, the heads 1 are moved between a printing position depicted in FIG. 1 which is suitable for the print process onto the sheet P and a retracting or waiting position depicted in FIG. 2 which is positioned above the printing position. In the retracting position, the wiping by a wiper blade 41 which will be described later can he performed.

The sheet sensor 32 is disposed on the upstream side of the feed roller pair 24 to detect the front end of the sheet P conveyed. A detection signal outputted when the front end of the sheet P is detected by the sheet sensor 32 is used for the synchronization between the driving of the head(s) 1 and the driving of the conveyance mechanism 8 at the time of the image formation onto the sheet P. Accordingly, the image is formed in accordance with a desired resolution and speed.

In the space B, the feed unit 1*c* is disposed. The feed unit 1*c* includes a feed tray 20 and a feed roller 21. The feed tray 20 is removably installed to the easing 101*a*. The feed tray 20 can load or accommodate a plurality of sheets P. The feed roller 21 feeds the sheet P positioned uppermost in the feed tray 20.

In the following explanation, a subsidiary or secondary scanning direction means a direction parallel to a conveyance direction D (direction indicated by the arrow D in FIG. 1) in which the sheet P is conveyed by the feed roller pairs 23 to 25. A main scanning direction means a direction which is parallel to a horizontal plane and is perpendicular to the subsidiary scanning direction.

In the space C, cartridges 4 storing the four color inks respectively are detachably installed to the casing 101*a*. Each of the cartridges 4 storing one of the four color inks is connected to one of the heads 1 via an ink tube or the like. In a case that the ink of each of the heads 1 is consumed, the ink of one of the cartridges 4 is supplied to the head 1.

Figure 2:
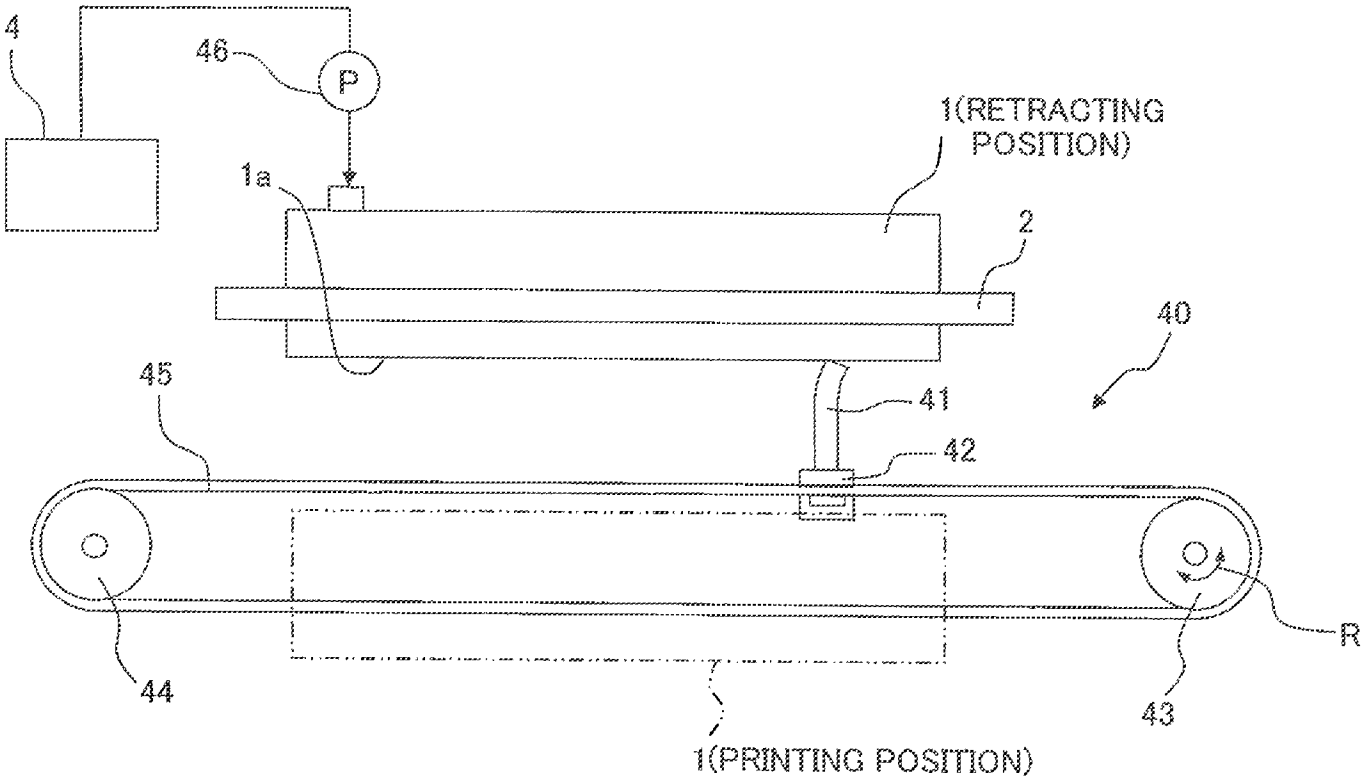
FIG. 2 is a schematic front view depicting a structure of a maintenance unit.

In the space A, a maintenance unit 40 is also provided. As depicted in FIG. 2, the maintenance unit 40 includes the wiper blade 41, rollers 43, 44, and an endless belt 45 put around the rollers 43, 44. The wiper blade 41 is a plate-shaped member made of an elastic material such as rubber. The wiper blade 41 is provided upstandingly on the upper surface of a fixed base 42, and the wiper blade 41 is disposed at a height which allows the upper end of the blade to abut against the discharge surface la in a case that the head 1 is in the retracting position. The fixed base 42 is fixed to the endless belt 45. The roller 43 is connected to a drive motor, and the roller 43 is rotatable in both directions indicated by the arrow R in FIG. 2. The drive motor is operated based on the control of the controller 100. The rotation of the roller 43 by the drive motor makes the endless belt 45 travel, which makes it possible to perform a wiping operation in which the discharge surface la of the head 1 is wiped with the wiper blade 41. The maintenance unit 40 includes a pump 46. The pump 46 is controlled by the controller 100 to make the ink from the cartridge 4 flow into the head 1 forcibly. Accordingly, it is possible to perform a purge operation in which the ink in the head 1 is discharged from the discharge ports 108.

Figure 3:
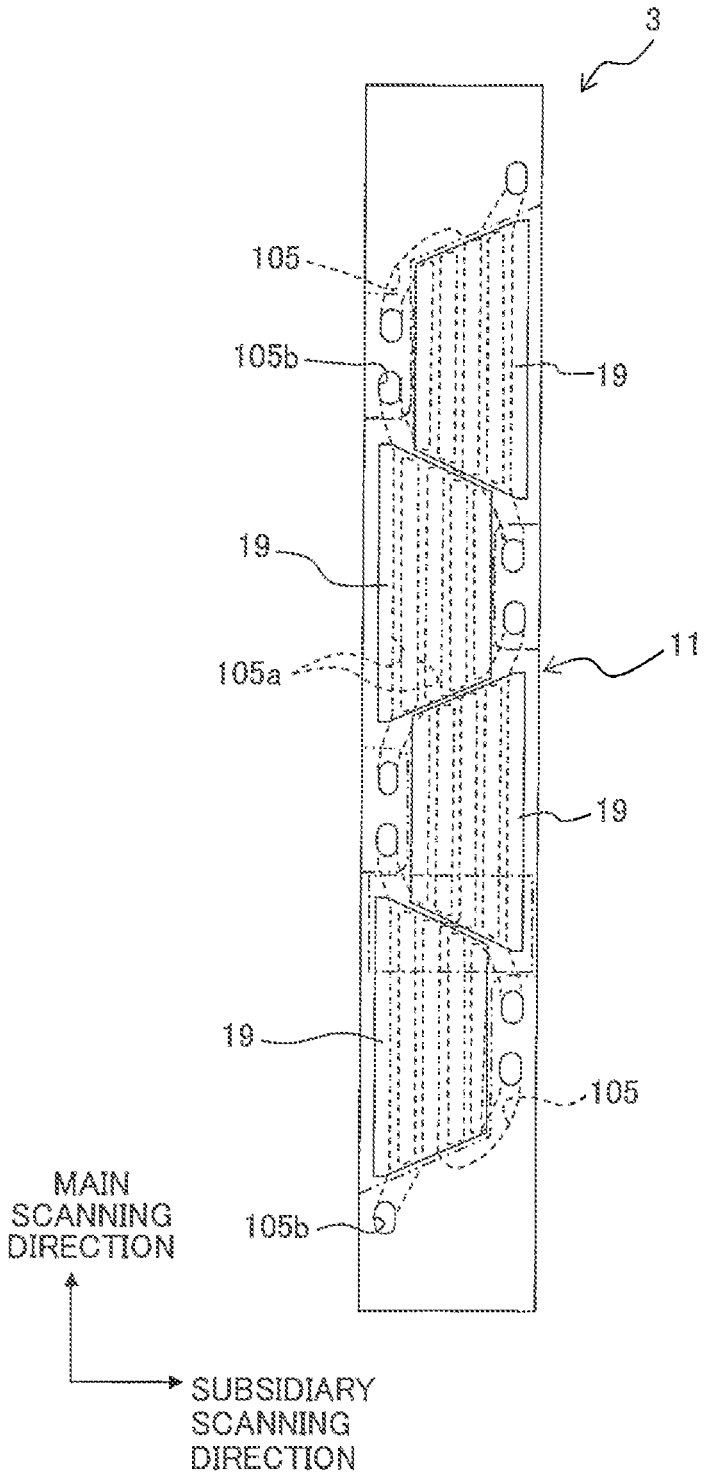
FIG. 3 is a plan view of a head body.

Subsequently, an explanation will be made in detail about a structure of the head 1 based on FIG. 3 and FIGS. 4A to 4C. As depicted in FIG. 3, the head 1 has a head body 3 with ink channels formed therein. The ink from the cartridge 4 flows into the head body 3 which is a lower structure of the head 1 via a reservoir unit which is an upper structure of the head 1. The head body 3 includes a channel unit 11 with the ink channels formed therein and actuator units 19 to apply pressure to the ink in the ink. channels. The channel unit 11 is a channel member formed such that nine rectangular-shaped metal plates 122, 123, 124, 125, 126, 127, 128, 129, 130 (see FIG. 4B) having the substantially the same size, are stacked and bonded to one another. As depicted in FIG. 3, openings 105*b* are formed on the upper surface of the channel unit 11. The ink from the reservoir unit flows into the openings 105*b* via filters. Foreign substances and the like in the ink are filtrated through the filters when the ink flows into the channel unit 11 from the openings 105*b*.

Figure 4A:
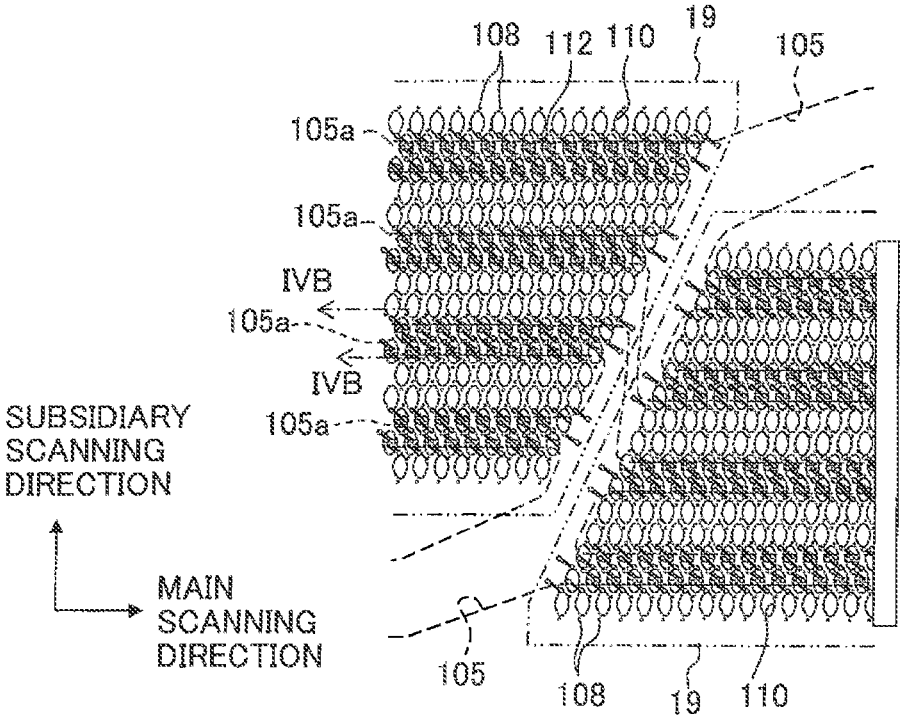
FIG. 4A is an enlarged view illustrating an area of FIG. 3 surrounded by the one-dot chain line.
Figure 4B:
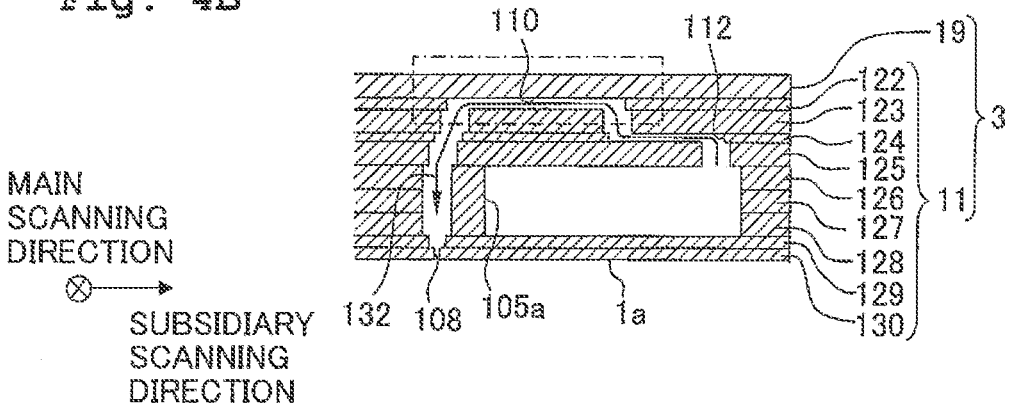
FIG. 4B is a cross-sectional view taken along a line IVB-IVB of FIG. 4A.

As depicted in FIG. 3 and FIGS. 4A to 4C, the ink channels in the channel unit 11 include a plurality of manifold channels 105 each of which has one of the openings 105*b* at one end thereof, a plurality of sub-manifold channels 105*a* (exemplary first channels) branched from each of the manifold channels 105, and a plurality of individual ink channels 132 (exemplary second channels) each of which ranges from the outlet of the sub-manifold channel 105*a* to the discharge port 108 via a pressure chamber 110. FIG. 4A depicts the pressure chambers 110 and apertures 112 disposed on the lower side of each actuator unit 19 with solid lines which should have been dotted lines.

As depicted in FIG. 3, the actuator units 19 each having a trapezoidal flat shape are arranged in two rows of a zigzag pattern on the upper surface of the channel unit 11. As depicted in FIG. 4A, many pressure chambers 110 are formed to open in the upper surface of the channel unit 11, and each of the pressure chambers 110 is open to have a substantially rhombic shape. The openings of the pressure chambers 110 are formed in an trapezoidal area, of the channel unit 11, facing each of the actuator units 19. The same number of discharge ports 108 as the number of pressure chambers 110 is formed to open in the lower surface (discharge surface 1*a*) of the channel unit 11. The discharge ports 108 are arranged in the main scanning direction with a predetermined regular interval intervening therebetween, the interval corresponding to a printing resolution, and the discharge ports 108 are arranged in the subsidiary scanning direction in a distributed manner.

Figure 4C:
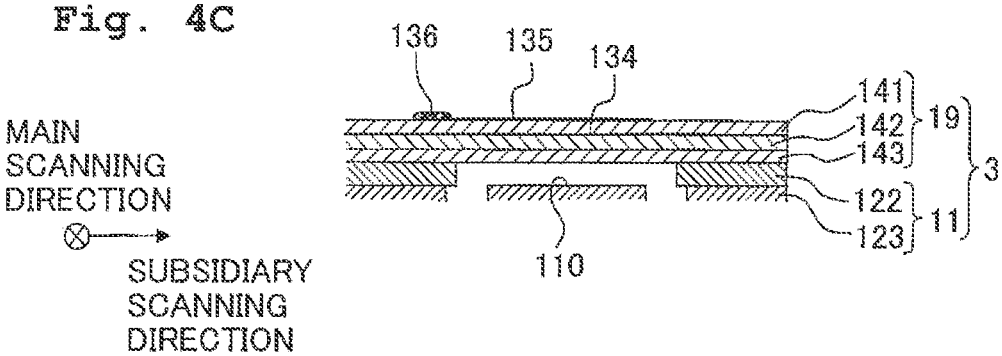
FIG. 4C is an enlarged view illustrating an area of FIG. 4B surrounded by the one-dot chain line.

The actuator unit 19 is a ceramics of lead zirconium titanate (PZT) which is ferroelectric. As depicted in FIG. 4C, the actuator unit 19 is formed of three piezoelectric layers 141 to 143. A plurality of individual electrodes 135 are formed in the upper surface of the uppermost piezoelectric layer 141, which is polarized in a thickness direction. Individual lands 136 to which a driving signal is supplied are formed at the front ends of the individual electrodes 135. A common electrode 134 is formed over the upper surface of the piezoelectric layer 142. The common electrode 134 is always kept at a ground potential. In a case that the individual electrode 135 holds the electric potential other than the ground potential, the electric potential difference between the common electrode 134 and the individual electrode 135 occurs. This causes an electric filed, in a polarization direction, between the common electrode 134 and the individual electrode 135, which allows the piezoelectric layer 141 (drive active portion) between these electrodes to contract in a plane direction. Since neither the piezoelectric layer 142 nor the piezoelectric layer 143 deforms spontaneously, the strain difference between the piezoelectric layer 141 and the piezoelectric layers 142, 143 occurs. As a result, a part sandwiched between the individual electrode 135 and the pressure chamber 110 bends to be convex toward the pressure chamber 110 (unimorph deformation).

The head 1 further includes an electronic component such as a driver IC 151 (see FIG. 5, exemplary signal supply unit) which supplies the driving signal to each actuator unit 19. The driver IC 151 generates the driving signal based on a control signal from the controller 100. Driving signals are selectively supplied to each of the individual electrodes 135 through one of the individual lands 136. In a case that the driving signal is supplied to the individual electrode 135, the electric potential difference between the common electrode 134 and the individual electrode 135 occurs. This causes the unimorph deformation in portions, of the piezoelectric layers 141 to 143, corresponding to the individual electrode 135 to which the driving signal is supplied, to apply pressure to the ink in the pressure chamber 110 corresponding to the individual electrode 135.

Figure 5:
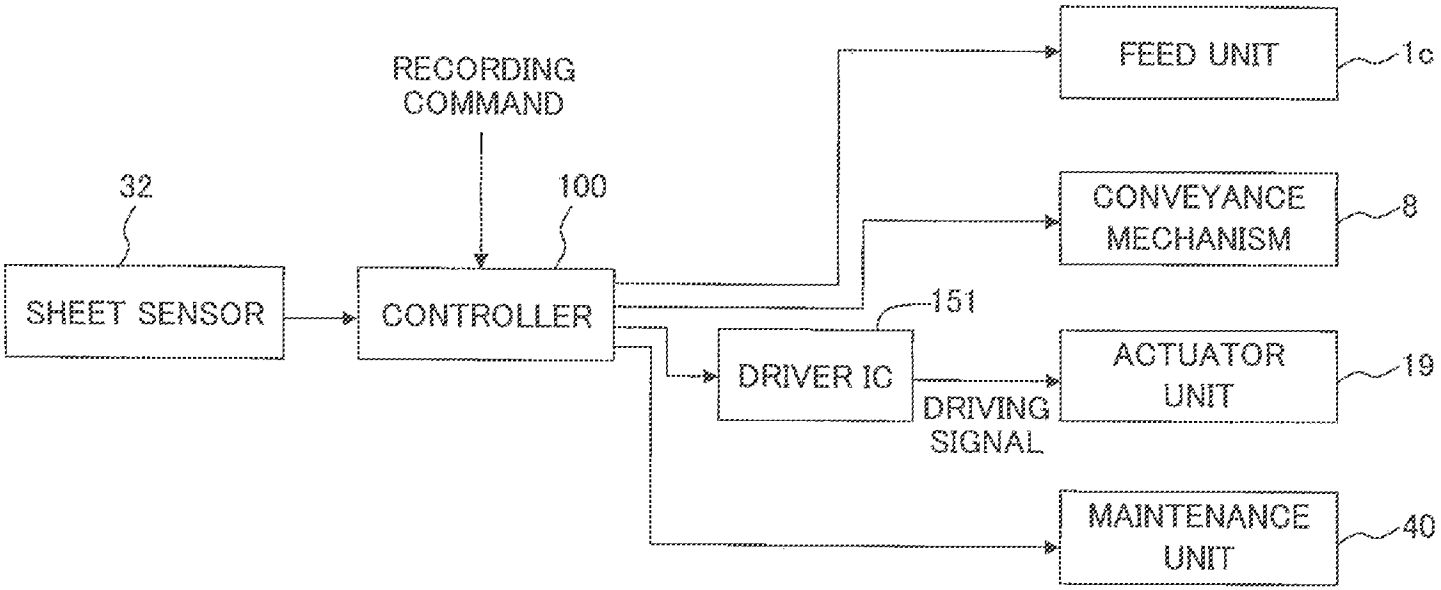
FIG. 5 is a functional block diagram depicting an electrical configuration of a controller and its peripheral mechanism.

Subsequently, an explanation will be made in detail about the control of each part by the controller 100 while referring to FIG. 5. As depicted in FIG. 5, the controller 100 controls the driver IC 151, the conveyance mechanism 8, and the like, based on a recording command (image data, etc.) supplied from an external apparatus (PC or the like connected to the printer 101) to cause each of the parts to perform the printing operation. The controller 100 causes the feed unit 1*c* and the conveyance mechanism 8 (feed roller pairs 22 to 28) to start the operation upon receipt of the recording command.

The sheet P fed from the feed tray 20 along the thick arrows in FIG. 1 is guided by the guide unit 9*a* disposed on the upstream side to be conveyed onto the platen 5. At the same time, the controller 100 controls the driver IC 151 to supply the driving signal to each actuator unit 19. Accordingly, the controller 100 causes the head 1 to discharge the ink from the discharge ports 108 when the sheet P passes directly below each head 1 in the conveyance direction D in FIG. 1. The droplets of ink discharged from the head 1 form dots on the sheet P, so that a predetermined image is formed on the sheet P. In this situation, the controller 100 controls the discharge timing of ink based on the detection signal from the sheet sensor 32. The sheet P with the image formed thereon is conveyed along the thick arrows in FIG. 1 while being guided by the guide unit 9*b* disposed on the downstream side, and then the sheet P is discharged on the discharge unit 31 from the upper part of the casing 101*a*.

The controller 100 controls the maintenance unit 40 to perform the wiping operation and the purge operation. In the wiping operation, the discharge surface 1*a* is wiped to regulate the meniscus of each discharge port 108. In the purge operation, the dried ink is discharged from the discharge ports 108. These operations restore or recover the discharge performance of ink in each of the discharge ports 108.

An explanation will be made in detail about the driving signal to be supplied to each actuator unit 19 by the driver IC 151. In the following description, "signal Sx" means a signal having a waveform Sx. As depicted in a signal S1 of FIG. 6, a signal S2 of FIG. 7A, and the like, the driving signal includes portions where the individual electrode 135 is allowed to be the ground potential Vg (hereinafter referred to as L signals) and portions where the individual electrode 135 is allowed to be an electric potential V0 (V0>Vg) (hereinafter referred to as H signals). By arranging the H signal and the L signal alternately, a plurality of pulses are formed in each of the signals. 1 unit of each of the driving signals is made to be a length of time corresponding to an exact one print period. The one print period is equal to a time required for the conveyance mechanism 8 to convey the sheet P by a predetermined unit of distance corresponding to the printing resolution (for example, 600 dpi).

There are two kinds of driving signals in this embodiment, the driving signals including a discharge driving signal and a non-discharge driving signal. The discharge driving signal is a signal to discharge the ink from the discharge ports 108 by driving the actuator unit 19. This signal is used for the printing operation. The non-discharge driving signal is a signal to drive the actuator unit 19 to an extent that the ink is not discharged. This signal is used to prevent the ink from drying by vibrating the ink in the vicinity of each discharge port 108.

Figure 6:
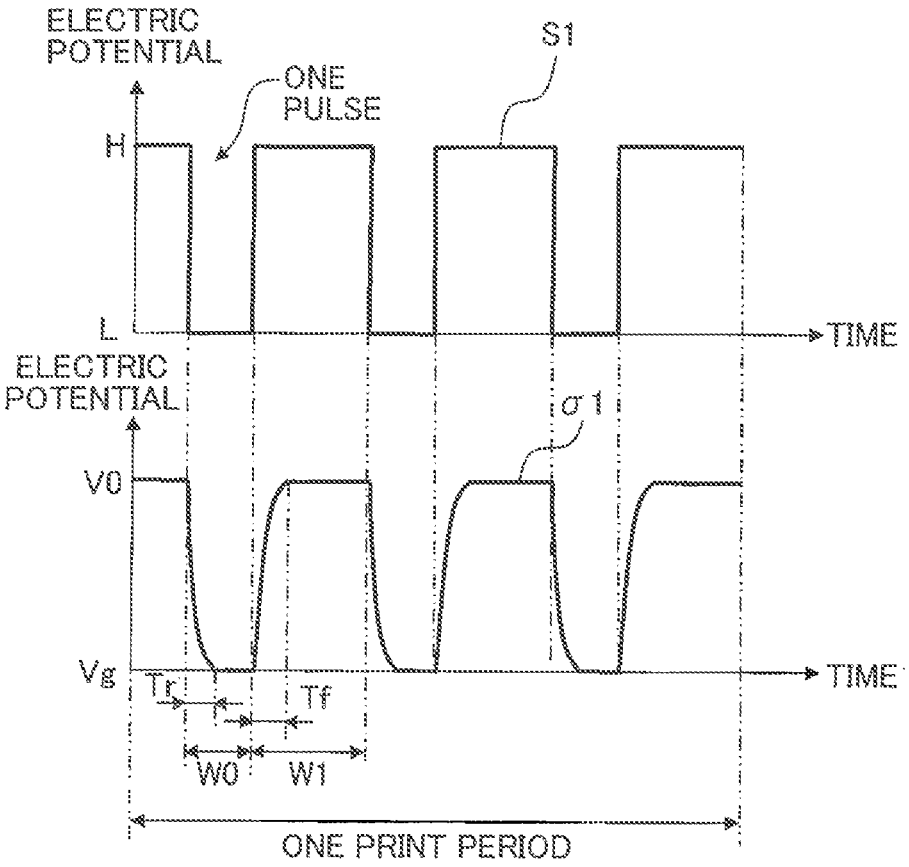
FIG. 6 is a graph illustrating the waveform of a discharge driving signal supplied to an actuator unit by a driver IC and the waveform indicating the change in electric potential of an individual electrode caused when the discharge driving signal is supplied.

The waveform of the signal S1 of FIG. 6 is an exemplary waveform of the discharge driving signal. The signal S1 is formed by arranging the L signal having a width W0 and the H signal having a width W1 alternately.

Each individual electrode 135 is usually maintained at the electric potential V0 by the driver IC 151 in a print period during which no ink is discharged. The driver IC 151 supplies the signal S1 to the individual electrode 135 every time when a print period during which the ink is required to be discharged comes. As will be descried later, the non discharge driving signal may be supplied in the print period during which no ink is discharged. A waveform al of FIG. 6 represents the change in electric potential in the individual electrode 135 caused when the signal S1 is supplied to the individual electrode 135. The waveform σ1 includes a transient period Tr and a transient period Tf, the transient period Tr being a period in which the electric potential of the individual electrode 135 is gradually changed from V0 to Vg, and the transient period Tf being a period in which the electric potential of the individual electrode 135 is gradually changed from Vg to V0. The length of the transient period Tr is equal to the length of the transient period TE In the following description, the wording "Tr" simply described means a length of the transient period Tr. Tr is smaller than both of W0 and W1.

In a case that the electric potential of the individual electrode 135 is kept at V0, the electric potential difference between the common electrode 134 and the individual electrode 135 is generated. The voltage corresponding to this electric potential difference is an exemplary predetermined voltage of the present teaching. Further, the state in which the voltage between the common electrode 134 and the individual electrode 135 is kept at this predetermined voltage is an exemplary first state in the present teaching. In this state, a portion, of the piezoelectric layer 141, sandwiched between these electrodes has the unimorph deformation, that is, the portion bends to be convex toward the pressure chamber 110.

In a case that the signal S1 is supplied to the individual electrode 135, the electric potential changes to have the waveform σ1, and thus the electric potential starts to monotonically decrease from V0. Then, the electric potential of the individual electrode 135 is allowed to be Vg temporarily. The state in which the voltage between the common electrode 134 and the individual electrode 135 monotonically decreases is an exemplary second state of the present teaching. In a case that the electric potential of the individual electrode 135 reaches Vg, the electric potential difference between the common electrode 134 and the individual electrode 135 no longer exists, and thus the unimorph deformation is released. By letting the unimorph deformation be released, the volume or capacity of the pressure chamber 110 increases, which applies negative pressure to the ink in the pressure chamber 110.

In a case that a time W0 has elapsed after a point of time at which the change of the electric potential from V0 to Vg is started, the electric potential of the individual electrode 135 starts to monotonically increase from Vg and is allowed to be V0 again. The state in which the voltage between the common electrode 134 and the individual electrode 135 increases monotonically is an exemplary third state of the present teaching. This causes again the electric potential difference between the common electrode 134 and the individual electrode 135, and thus the unimorph deformation occurs. The unimorph deformation decreases the volume of the pressure chamber 110, which applies positive pressure to the ink in the pressure chamber 110.

Here, W0 is adjusted so that a subsequent application of positive pressure is performed at a timing, at which the pressure wave caused to the ink in the pressure chamber 110 by the first application of negative pressure is propagated in an extending direction of the individual ink channel 132 and reversed and the peak of positive pressure comes to the pressure chamber 110. (i.e. one half of the one way propagation time of a pressure wave in the individual ink channel 132) Such W0 is equal to T0/2 in a case that the proper or characteristic vibration period of the individual ink channel 132 is made to be T0. Accordingly, the subsequent application of positive pressure is superposed on the peak of positive pressure which is caused by the first application of negative pressure, and thus the pressure is applied to the ink in the pressure chamber 110 efficiently. Therefore, the ink is discharged from each discharge port 108 efficiently. Further, W1 is adjusted so that the vibration, which is caused in the pressure chamber 110 due to the supply of a rectangular pulse, is less likely to affect the discharge of ink which is caused by the supply of a subsequent rectangular pulse.

As described above, the ink is discharged once every time when one pulse having the width W0 in the signal S1 (see FIG. 6) is supplied to the individual electrode 135. The pulses each having the width W0 are included in the signal S1 with a time interval W1 intervening therebetween. Thus, in a case that one signal S1 is supplied to the individual electrode 135, the ink is discharged once every time when W1 comes. A portion, of the signal S1, including one pulse having the width W0 is an exemplary voltage signal of the present teaching.

Figure 7A:
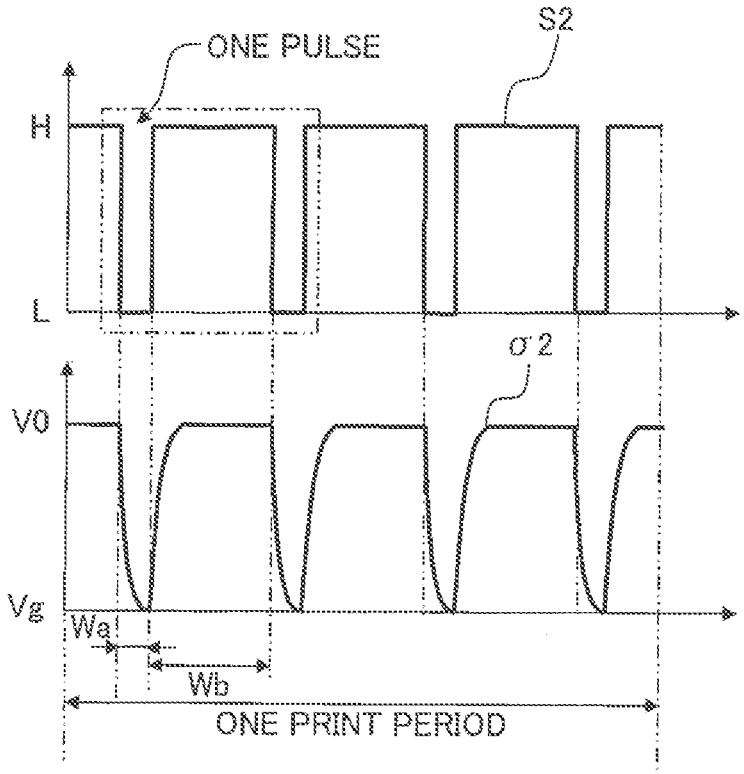
FIG. 7A is a graph illustrating the waveform of a non-discharge driving signal supplied to the actuator unit by the driver IC and the waveform indicating the change in electric potential of the individual electrode caused when the non-discharge driving signal is supplied.
Figure 7B:
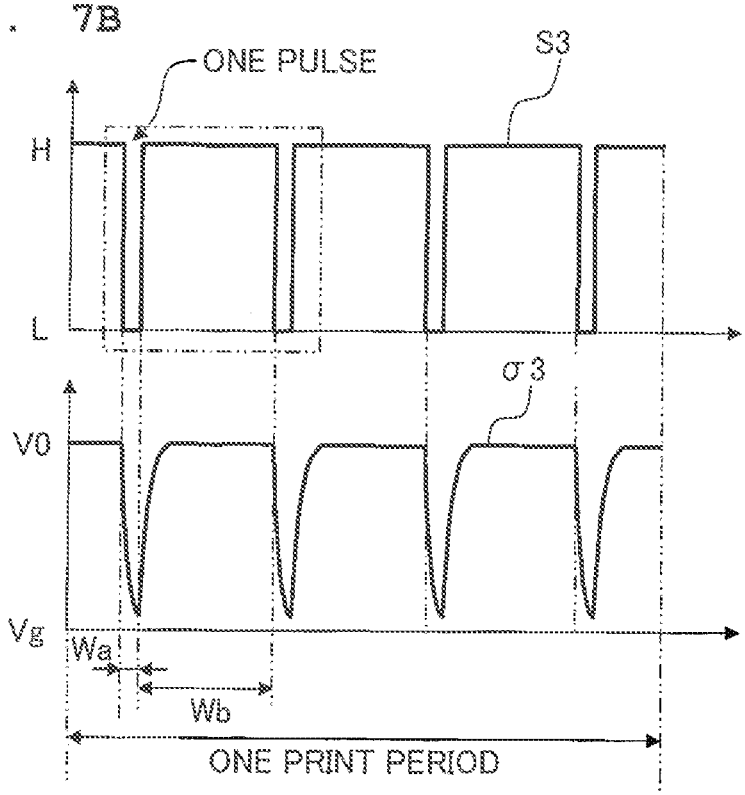
FIG. 7B is a graph illustrating the waveform of another non-discharge driving signal which is different from the non-discharge driving signal depicted in FIG. 7A and the waveform indicating the change in electric potential of the individual electrode caused when the another non-discharge driving signal is supplied.

The signal S2 in FIG. 7A and a signal 53 in FIG. 7B are examples of the non-discharge driving signal. A waveform σ2 in FIG. 7A and waveform σ3 in FIG. 7B respectively represent the change in electric potential in the individual electrode 135 caused when the signal S2 and the signal S3 are respectively supplied to the individual electrode 135. The transient period in which the electric potential of the individual electrode 135 is gradually changed occurs also in the case that the non-discharge driving signal is supplied, similar to the case in which the discharge driving signal is supplied. The length of the transient period in which the electric potential is changed from V0 to Vg the same as that of the discharge driving signal, that is, Tr. Further, the length of the transient period Tf in which the electric potential is changed from Vg to V0 also has the length Tr.

Similar to the discharge driving signal (S1), the non-discharge driving signal is configured by arranging the H signal and the L signal alternately. In each of the signals, a width of the L signal is constant and a time interval between the L signals is also constant. In the following description, the width of the L signal in the non-discharge driving signal is referred to as Wa and the time interval between the L signals is referred to as Wb. In a case that the non-discharge driving signal is supplied to the individual electrode 135, the electric potential of the individual electrode 135 monotonically decreases to Vg (exemplary second state) from the state in which the electric potential of the individual electrode 135 is maintained at V0 (exemplary first state), and then the electric potential monotonically increases (exemplary third state) to go back to the state in which the electric potential of the individual electrode 135 is maintained at V0. Thus, negative pressure is applied to the ink in the pressure chamber 110 when the electric potential of the individual electrode 135 monotonically decreases, and then positive pressure is applied to the ink in the pressure chamber 110 when the electric potential of the individual electrode 135 monotonically increases.

The width Wa of the L signal corresponds to a length ranging from the start point of the second state to the start point of the third state, and the width Wa of each of the L signals in the non-discharge driving signal is constant. The time interval Wb between the L signals corresponds to a length ranging from the start point of the third state of the former pulse, of any two pulses (for example, two pulses surrounded by the frame depicted by alternate long and two short dashes line in FIG. 7A), to the start point of the second state of the latter pulse, and the time interval Wb between the L signals in the non-discharge driving signal is constant.

Here, unlike W0 in the discharge driving signal, Wa is adjusted so that a subsequent application of positive pressure is performed at a timing which is deviated from the timing of the peak of positive pressure, which is caused in the pressure chamber 110 due to the first application of the negative pressure. That is, Wa is adjusted to be a length different from T0/2. Further, according to an exemplary operation, Wa is not more than one-fifth of the time elapsed after negative pressure is applied into the pressure chamber 110 until the vibration of the ink in each discharge port 108 peaks first. By adjusting Wa as described above, the non-discharge driving signal is adjusted so that no ink is discharged from each discharge port 108 even when the non-discharge driving signal is supplied to the individual electrode 135.

Specifically, each of the non-discharge driving signals of this embodiment is adjusted to satisfy two conditions of condition 1: Wa<Tr and condition 2: T0<Wb <T0+2* Tf. By adopting these conditions, the ink in the vicinity of each discharge port 108 (meniscus) is successfully prevented from drying as described in an operation test as will be described later. Further, each of the non-discharge driving signals is adjusted to satisfy a condition 3 in which a maximum number of pulses each having the width Wa is included, with the time interval Wb intervening therebetween, in each of the signals having a length of one print period. By meeting the condition 3, the pulses having the same width Wa are arranged, with the same time interval Wb intervening therebetween, in each of the signals. Thus, it is possible to efficiently vibrate the ink in the vicinity of each discharge port 108. Further, since the maximum number of pulses is included in each of the signals, it is possible to effectively vibrate the ink in the vicinity of each discharge port 108. Each of the signals S2 and S3 is an exemplary signal satisfying the conditions 1 to 3.

The signal S2 is adjusted to satisfy, in addition to the conditions 1 to 3, further three conditions as follows: condition 4: Wa=Tr, condition 5: Wb=T0+Tf, and condition 6: (Wa+Wb) * 4=one print period. The conditions 4 and 5 are examples of those satisfying the conditions 1 and 2. By meeting the condition 4, the electric potential of the individual electrode 135 changes as follows. That is, the electric potential decreases from VO to Vg every time when one pulse is supplied. Once the electric potential reaches Vg, the electric potential starts to increase, and then goes back to V0. By meeting the condition 5, Wb takes an intermediate value within a range of the condition 2, and thus the effect for preventing the ink from drying can be securely obtained By meeting the condition 6, in a case that the plurality of signals S2 are consecutively supplied to the individual electrode 135 without interruption, respective pulses are repeatedly supplied to the individual electrode 135 at regular intervals. Accordingly, the ink in the vicinity of each discharge port 108 can be vibrated efficiently by using the plurality of signals.

The signal S3 is adjusted to further satisfy a condition 7: Wa<Tr, in addition to the conditions 1 to 3. By meeting the condition 7, the electric potential of the individual electrode 135 changes as follows. That is, the electric potential decreases from V0 to Vg every time when one pulse is supplied. The electric potential starts to increase immediately before reaching Vg, and then goes back to V0. As described above, since the electric potential of the individual electrode 135 changes to increase before reaching Vg, the degree of unimorph deformation is also small. The intensity of pressure to be applied into the pressure chamber 110 is restricted and the magnitude of vibration caused in the meniscus in the vicinity of each discharge port 108 is restrained, and thus it is possible to prevent the ink from being discharged more reliably.

Figure 8:
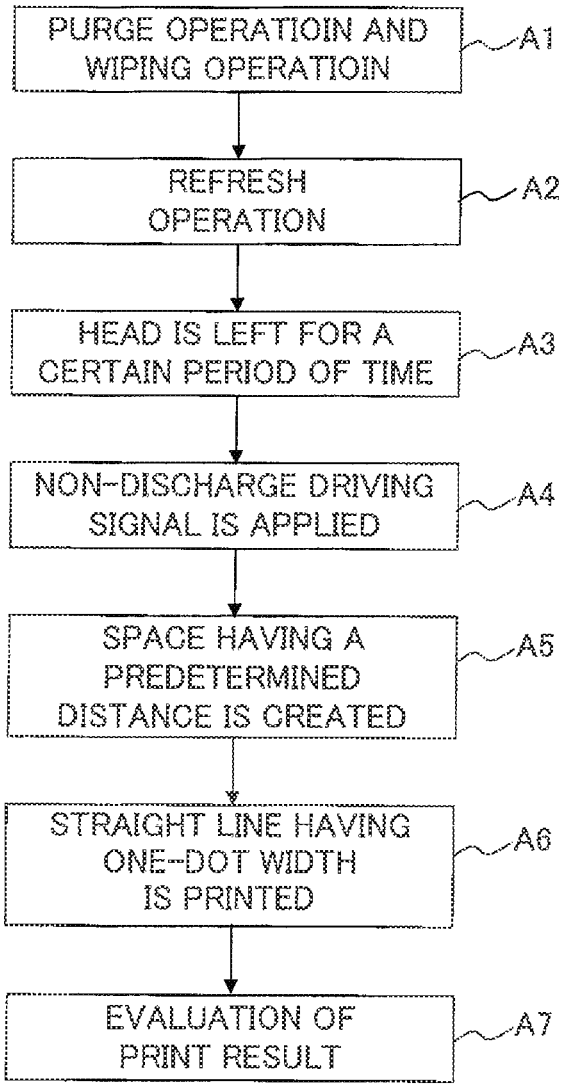
FIG. 8 is a flowchart illustrating the flow of an operation test of a printer.
Figure 9:
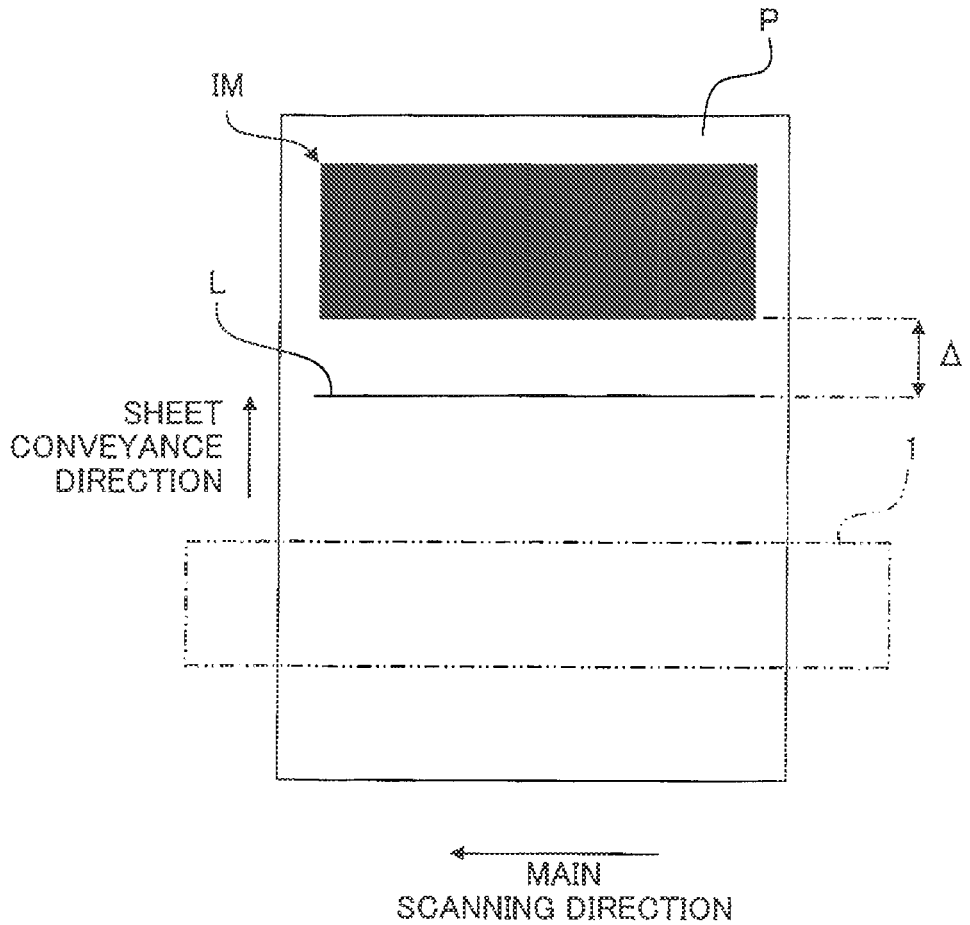
FIG. 9 is an exemplary image which is formed on a sheet in the operation test of FIG. 8.
Figure 10:
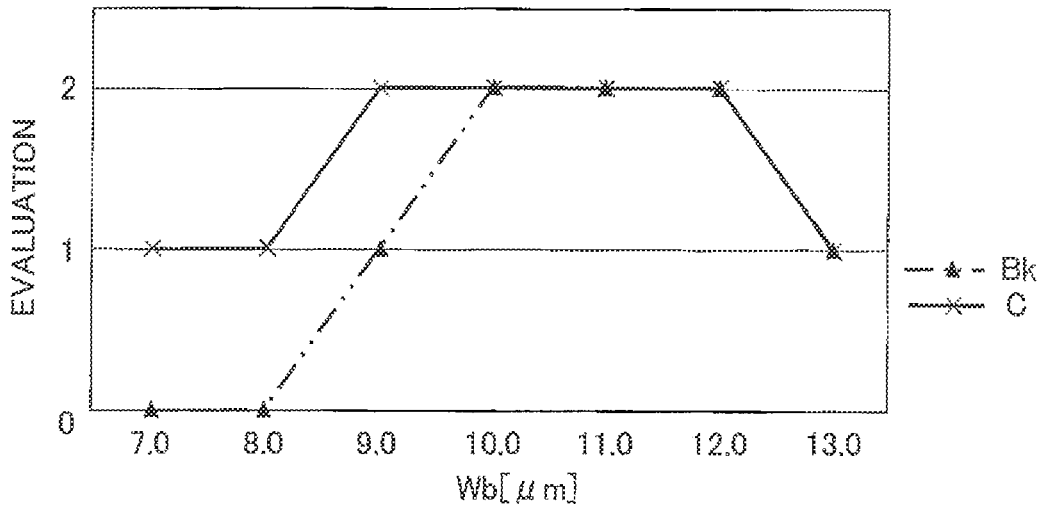
FIG. 10 is a graph illustrating evaluation results of images formed in accordance with the operation test of FIG. 8.

In the following, an explanation will be made about an operation test according to this embodiment while referring to FIGS. 8 to 10. The printer 101 used in this operation test is configured to execute the conveyance of the sheet P, the discharge of ink, the purge operation, the wiping operation, and the like under various conditions upon commands sent to the controller 100 from the outside. In this operation test, at first, the purge operation and the wiping operation are performed in the printer 101 (step A1 in FIG. 8). By performing these operations, the discharge performance of each head 1 recovers to some extent. Next, a refresh operation in which the ink is discharged onto the sheet P from each head 1 while the sheet P is conveyed is performed (step A2). The refresh operation is an operation for discharging the ink onto the sheet P from all of the discharge ports 108 of each head 1 at the same time. For example, as depicted in FIG. 9, an image IM is formed on the sheet P by the refresh operation. The image IM is a rectangular image of which entire area is filled with one color. By performing this operation, all of the discharge ports 108 have substantially the same discharge condition at the point of time immediately after the image IM is formed.

Subsequently, each head 1 is left in a state of discharging no ink for a certain period of time (for example, 10 seconds) (step A3). This promotes the drying of ink in the vicinity of each discharge port 108. Next, a predetermined number of non-discharge driving signals are supplied to the individual electrode 135 corresponding to each discharge port 108 (step A4). This vibrates the ink in the vicinity of each discharge port 108 to an extent that no ink is discharged to prevent the drying of ink. Next, the sheet P is conveyed to create a space having a predetermined distance (A in FIG. 9) from the lower end of the image IM in a sheet conveyance direction (step A5), Next, the ink is discharged from all of the discharge ports 108 by an amount of one print period to form, on the sheet P, a straight line L in the main scanning direction which has one-dot width with respect to the sheet conveyance direction (subsidiary scanning direction) (step Ad). Then, the print result of the straight line L is visually evaluated (step A7). As the drying of ink is prevented more effectively by supplying the non-discharge driving signals in step A4, a better straight line L (more linear straight line L) is fanned in the main scanning direction. On the other hand, in a case that the effect for preventing the drying of ink in step A4 is low, the ink discharge timing from the discharge ports 108 vary. As a result, the straight line L is formed in a wavelike shape in the sheet conveyance direction. In a case that the effect for preventing the drying of ink falls below a certain level, no ink is discharged from each discharge port 108 due to the drying of ink to cause dot-missing in the straight line L.

The above operation test was performed on the heads 1 corresponding to black ink and cyan ink respectively, in a state that Wa in the non-discharge driving signal of step A4 is fixed to 1 μm and that Wb is varied between 7.0 μm and 13.0 μm by 1.0 μm. In the respective heads 1 used in this operation test, T0 was 10.0 microseconds (μs) and Tr was 1.0 μs. In this case, Tr<T0/5 is satisfied. FIG. 10 depicts this result. In FIG. 10, the horizontal axis represents the values of Wb and the vertical axis represents the evaluation results in step A7. The results are evaluated according to three levels of 0, 1, and 2. The evaluation result on level 2 means that the straight line L was hardly affected by the deviation of ink discharge timing and the result was acceptable. The evaluation result on level 1 means that the straight line L was affected by the deviation of ink discharge timing. The evaluation result on level 0 means that the straight line L had the dot-missing, that is, non-discharge of ink occurred. In FIG. 10, "Bk" represents the result corresponding to the black ink and "C" represents the result corresponding to the cyan ink. FIG. 10 depicts that the black and cyan inks are prevented from drying effectively in step A4 in a case that T0≤Wb≤T0+2*Tr was satisfied. As the operation condition of the printer 101, Wb=T0+Tr is preferably used. In this case, Wb is an intermediate value in the range of T0≤Wb≤T0+2*Tr. Therefore, the ink can be prevented from drying more reliably.

In the above description, the preferred embodiment of present teaching has been explained. However, the present teaching is not restricted to the above embodiment, and it is possible to make various design changes within the scope of the claims.

In the above embodiment, the signal S2 which is an exemplary non-discharge driving signal satisfies the condition 6 ((Wa+Wb)*4=one print period). Accordingly, the ink in the vicinity of each discharge port 108 can be effectively vibrated when the plurality of signals S2 are supplied to the individual electrode 135. Instead of the condition 6, it is allowable to adopt a condition: (Wa+Wb)n=one print period (n is any natural number except 4). By meeting this condition, similar to the condition 6, respective pulses are repeatedly supplied to the individual electrode 135 at regular intervals when the plurality of signals S2 are consecutively supplied to the individual electrode 135 without interruption.

The liquid discharge apparatus according to the present teaching is not limited to the printer, and the present teaching is applicable to a facsimile machine, a copying machine, and the like. The number of heads used in the liquid discharge apparatus is not limited to one. Two or more of heads may be used in the liquid discharge apparatus. The head is not limited to the head of the line type, and the head of a serial type may be used. The liquid discharge apparatus according to the present teaching may discharge liquid other than ink.

What is claimed is:

1. A liquid discharge apparatus configured to discharge liquid, comprising:

a channel unit including:

a discharge port through which the liquid is discharged;

a first channel through which the liquid flows to be supplied to the discharge port; and a second channel which has one end communicated with the first channel and the other end communicated with the discharge port;

an actuator including:

a first electrode;

a second electrode; and a piezoelectric layer sandwiched between the first and second electrodes, and being configured to apply pressure to the liquid in the second channel by deforming the piezoelectric layer relative to the second channel due to a difference in electric potential between the first and second electrodes; and a signal supply unit configured to selectively supply a discharge driving signal and a non-discharge driving signal to the actuator, the discharge driving signal including a first voltage signal which drives the actuator to discharge the liquid from the discharge port, and the non-discharge driving signal including a plurality of second voltage signals each of which drives the actuator not to discharge the liquid from the discharge port;

wherein each of the first voltage signal and the second voltage signals goes through a first state, a second state, and a third state in this order and goes back to the first state, the first state being a state in which a voltage between the first and second electrodes is kept at a predetermined voltage, the second state being a state in which the voltage between the first and second electrodes monotonically decreases from the predetermined voltage, the third state being a state in which the voltage between the first and second electrodes monotonically increases to the predetermined voltage; and the non-discharge driving signal is adjusted so that any two consecutive second voltage signals among the plurality of second signals satisfy a condition that:

$$T0 \leq Wb \leq T0+2*Tf;$$

where:

Wb is a length of time elapsed after the third state of the former second voltage signal is started until the second state of the latter second voltage signal is started;

T0 is a proper vibration period of the second channel; and

Tf is a length of time during which the voltage of the first voltage signal in the discharge driving signal is in the third state.

2. The liquid discharge apparatus according to claim 1;

wherein the non-discharge driving signal is adjusted so that the third state of each of the second voltage signals is started immediately after the second state of each of the second voltage signals is completed.

3. The liquid discharge apparatus according to claim 1;

wherein the non-discharge driving signal is adjusted so that:

the plurality of second voltage signals have a same length of time Wa elapsed after the second state of each of the second voltage signals is started until the third state of each of the second voltage signals is started;

any two consecutive second voltage signals have the same length of time Wb elapsed after the third state of the former second voltage signal is started until the second state of the latter second voltage signal is started; and a maximum number of second voltage signals is included in the non-discharge driving signal.

4. The liquid discharge apparatus according to claim 3;

wherein the non-discharge driving signal is adjusted to have one print period corresponding to a length of time obtained by:

$$(Wa+Wb)*n;$$

where n is a natural number; and wherein the signal supply unit is configured to consecutively supply a plurality of non-discharge driving signals to the actuator.

5. The liquid discharge apparatus according to claim 2;

wherein the non-discharge driving signal is further adjusted so that a length of time Wa is different from the value of T0/2, where Wa is a length of time elapsed after the second state of each of the second voltage signals is started until the third state of each of the second voltage signals is started.

6. The liquid discharge apparatus according to claim 2;

wherein the non-discharge driving signal is further adjusted to satisfy a condition that:

$$Wa \leq Tr;$$

where:

Wa is a length of time elapsed after the second state of each of the second voltage signals is started until the third state of each of the second voltage signals is started; and Tr is a length of time during which the voltage of the first voltage signal in the discharge driving signal is in the second state.

7. The liquid discharge apparatus according to claim 6;

wherein the non-discharge driving signal is further adjusted to satisfy conditions that:

$$Wa=Tr \text{ and } Wb=T0+Tr.$$

8. The liquid discharge apparatus according to claim 6;

wherein the non-discharge driving signal is further adjusted to satisfy a condition that:

$$Wa<Tr.$$

* * * * *